US007540945B2

(12) United States Patent
Marquéz Salvatierra

(10) Patent No.: US 7,540,945 B2
(45) Date of Patent: Jun. 2, 2009

(54) ANTICORROSIVE TREATMENT FOR SHAVING BLADES

(76) Inventor: Manuel Antonio Marquéz Salvatierra, Av. Concordia 0487, Peñaflor, Santiago (CL)

( * ) Notice: Subject to any disclaimer, the term of this patent is extended or adjusted under 35 U.S.C. 154(b) by 187 days.

(21) Appl. No.: 11/262,621

(22) Filed: Oct. 31, 2005

(65) Prior Publication Data

US 2007/0025898 A1 Feb. 1, 2007

(30) Foreign Application Priority Data

Jul. 29, 2005 (CL) ..... 1929-2005

(51) Int. Cl.
*C23F 13/20* (2006.01)

(52) U.S. Cl. ..... 204/196.37

(58) Field of Classification Search ..... 204/196.37
See application file for complete search history.

(56) References Cited

U.S. PATENT DOCUMENTS 3,242,064 A 3/1966 Byrne
3,692,650 A 9/1972 Kipps et al.
3,857,050 A * 12/1974 Harris et al. ..... 310/13
4,546,482 A * 10/1985 Bagaglia et al. ..... 372/86
4,658,365 A * 4/1987 Syrett et al. ..... 205/724
4,767,512 A 8/1988 Cowatch et al.
6,326,541 B1 * 12/2001 Goheen ..... 136/253
6,395,982 B2 * 5/2002 Nelson et al. ..... 174/555
6,488,834 B1 * 12/2002 Francis ..... 205/652

OTHER PUBLICATIONS

Websters New World Dictionary (1988) p. 207.*

* cited by examiner

*Primary Examiner*—Bruce F Bell
(74) *Attorney, Agent, or Firm*—DLA Piper LLP

(57) ABSTRACT

A device that prolongs the life of a shaving blade including a condenser, a pair of spaced apart and substantially parallel copper plates adapted to receive the shaving blade between the plates, a source of DC of 1.5V and a conductor of electricity that leads electrical energy from the source to the copper plates.

7 Claims, 4 Drawing Sheets

ANTICORROSIVE TREATMENT FOR SHAVING BLADES

RELATED APPLICATION

This application claims priority of Chilean Patent Application No. 1929-2005, filed Jul. 29, 2005, herein incorporated by reference.

FIELD OF THE INVENTION

This invention relates to a method and device to prevent oxidation of a shaving blade and prolong its life.

BACKGROUND

During the use of a shaving blade, there are two main processes which cause the deterioration of the original condition, these are:

Oxidation, and

Wear.

Oxidation or corrosion is understood to be the destruction or deterioration of a material due to the reaction with the environment. Chemically, oxidation consists of substances in a suitable oxidating atmosphere accepting an electron and they are reduced. The electron comes from atoms of the metal or from other items in the oxidating atmosphere. As the process of oxidation continues, the metal or item is degraded to the point that it can no longer be used for its original purpose.

To cease the process of corrosion, it is fundamental to stop the metal atoms loss of electrons from other atoms or ions. Corrosion is an electrochemical process, in as much as the chemical destruction accompanies the circulation of electricity.

The corrosive process, specifically as it relates to iron, is described by the reaction opposite to the one of reduction, in which we have following half reaction:

$$Fe^{2+} \rightarrow 2e^{-} Fe.$$

The value of the potential of reduction ($E^0$) for this half reaction is:

$$E^0 = -0.44 \text{ volts.}$$

The one that can be carried out towards the left if it is connected with another one whose value of potential of reduction of average cell is greater. This happens frequently in environmental conditions, since two of these reactions are those of reduction of protons and oxygen, to produce water and hydroxyl ion, respectively.

According to this we have the following half reactions with its respective values of potential of reduction:

$$O_2 + 4H + 4e^{-} 2H_2O \; E^0 \text{ reduction} = 1.23 \text{ volts}$$

$$2H_2O + 2e^{-} H2 + 2OH^{-} E^0 \text{ reduction} = -0.42 \text{ volts.}$$

Both reactions connected with those of iron spontaneously give rise to the oxidation of the metal. In this way, when there is enough water, oxygen and acid, a saline atmosphere will cause the iron objects to oxidize little by little. In this way, the iron oxidation and oxygen is reduced. The standard potential for the cell is:

$$E^0 \text{ cell} = +0.44 \text{ volts} + 1.23 \text{ volts} = 1.067 \text{ volts.}$$

The process is spontaneous. The complete reaction is:

$$Fe + O_2 + 4H + Fe^{2+} + 2H_2O.$$

Some suggest that the definition of corrosion should be restricted to metals. Nevertheless, corrosion engineers should frequently consider metals and non metals for the solution of a given problem. To illustrate, deterioration of a painting by the action of ultra-violet rays, chemically is fusion of the internal coatings, and the attack of a solid metal by another fused material is considered a phenomenon of corrosion.

On the other hand, it is known that all the metals and alloys are susceptible to corrosion. Nevertheless, all the materials are not corroded by effect of such elements. For example, gold is corroded in mercury at room temperature, iron is not corroded as well by mercury, but it oxidizes in environmental conditions, as we have already seen.

The processes of corrosion is classified depending on the means in which they are developed or its morphology, for example, it depends on the environment or atmosphere can be classified as:

A. Chemically: one studies under this denomination those cases wherein the metal reacts with non ionic means (for example: oxidation in air at high temperature)

B. Electrochemically: from the point of view of the metallic ion partition, all the processes of corrosion are electrochemical. Nevertheless, it is usual to designate corrosion as electrochemical as it implies a simultaneous transport of electricity through an electrolyte. To this important group belongs corrosion in saline solution and seawater, atmospheric corrosion, ground corrosion and the like.

Whereas the classification of the processes of corrosion depends on the form and is useful when the attack mechanisms are studied, it is very advisable when it is wanted to evaluate the damage produced by corrosion.

On the other hand, corrosion can cause diverse loss for industry, direct or indirect that is translated in replacement of corroded equipment, redesign of equipment in agreement with the type of corrosion, preventive maintenance, shutdown of equipment, product contamination, loss of product, loss of effectiveness, security, health, cost of the natural resources and appearance.

Due to these important consequences, many different means have been created to prevent it. In effect, the first methods consisted of applying a covering, for example, a painting to the metal object that is desired to be protected. In this way, the metal is protected from contact with the oxidant atmosphere preventing this form of corrosion. Nevertheless, after a time, this covering wears out and the process of corrosion begins. Therefore, the only way to prevent this corrosion from beginning again was to apply this covering again. This process has the disadvantage of being relatively expensive and impracticable, for example, in the case of manufacture of automobiles the covering would have to be applied to each part of separately and, once assembled, touched up. In the case of submarine pipes, the touch up process is not possible. This method is not viable.

Another process to prevent oxidation includes a cathodic system of protection. Where the protected metal objects are changed into cathodes of a electric circuit, the cathode or metal that is desired to be protected and an anode connects to a electric energy source, and the circuit is completed with a watery solution. Where the electric energy provides electrons, in such a way that the electron donation of the metal is reduced to protect the metal.

U.S. Pat. No. 3,242,064 discloses the cathodic protection through pulses of current applied to the surface of the metal, where the pulses are activated by variations in the water that surrounds the metal that is desired to be protected. U.S. Pat.

No. 3,692,650 describes a cathode protection system useful to apply to pipes buried in the ground. The system uses pulses of DC voltage.

U.S. Pat. No. 4,767,512 discloses a method to prevent corrosion with objects without the necessity of submerging them in a conductive medium. An electronic current is forced within the metal object since the metal is treated like a negative plate of a condenser. This is reached by connecting the condenser between the metal object and the medium to provide energy pulses. In one embodiment, Cowatch describes a device in which a voltage of 5,000 to 6,000 volts DC is applied to the positive plate of the condenser.

That invention presents security problems since applying a voltage of that magnitude to a plate that possibly can make contact with humans or animals can cause important health consequences.

SUMMARY OF THE INVENTION

This invention relates to a device that prolongs the life of a shaving blade including a condenser, a pair of spaced apart and substantially parallel copper plates adapted to receive the shaving blade between the plates, a source of DC of 1.5V and a conductor of electricity that leads electrical energy from the source to the copper plates.

This invention also relates to a method of prolonging useful life of a shaving blade including placing the shaving blade within a container that includes the device so that it is located between the parallel copper plates.

DETAILED DESCRIPTION

Figure 1:
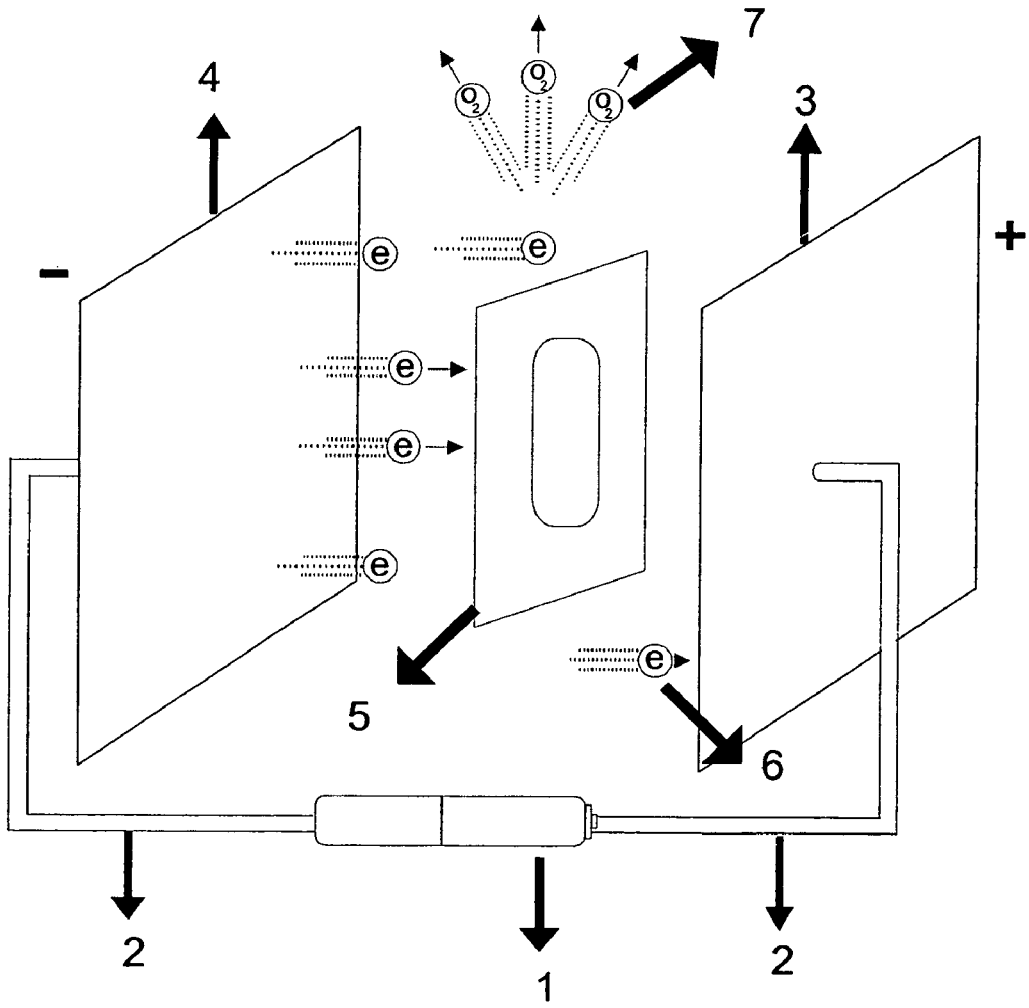
FIG. 1 is a schematic diagram of a device in accordance with aspects of the invention.

It will be appreciated that the following description is intended to refer to specific embodiments of the invention selected for illustration in the drawings and is not intended to define or limit the invention, other than in the appended claims.

This invention relates to a device that is easy to manipulate, is economical and secure, that serves to prolong the useful life of a shaving blade, as it efficiently prevents and or removes oxidates formed on the surface.

The device includes a condenser, parallel copper plates, a source of DC of 1.5V and means to conduct the electrical energy from the source to the copper plates. When a shaving blade that after some use shows oxidation, that is to say it displays molecules of FeO (oxidized iron), it is placed between the copper plates of the device. Then it is exposed to an electron flow and a magnetic field, where molecules of FeO react with air and also with electrons that circulate around the magnetic field produced by the device, thereby allowing the oxidate to dissociate due to the mixture of an electron that comes from the electrical energy source and that should have returned to it, but is left "trapped" in the iron molecules, producing "de-oxidation".

The device is able to prolong the useful life of a shaving blade through a simple mechanism of easy manipulation and that does not require a sacrifice anode.

The reactions of oxidation and "de-oxidation} are:

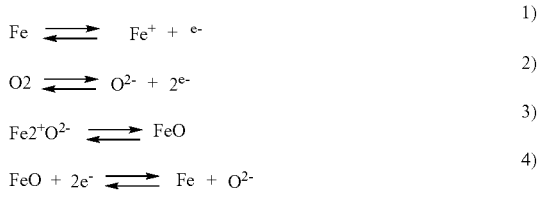

Reactions 1, 2 and 3 happen when the shaving blade is being used, and are direct causes of the oxidation. In reaction 1, the iron releases an electron. In reaction 2, oxygen dissociates, in this way releasing two electrons. In reaction 3, the oxygen ion reacts with the ion of the iron and they produce FeO, that corresponds to oxidized iron.

Reaction 4 takes place by intervention of the circuit of the invention, where oxidant is dissociated due to mixture with an electron that comes from the electrical energy source and should have returned to it, but is left "trapped" in molecules of iron.

Reaction 4 allows dissociation of FeO and production of Fe. This prolongs the useful life of a shaving blade, without the necessity of a sacrificial anode.

Also, the invention includes a method of prolonging the useful life of the shaving blade by placing the shaving blade in a container that includes the device described before.

Turning now to the drawings, in FIG. 1, the numeric reference (1) indicates a power source that corresponds to a battery of 1.5V that feeds the electric energy to the device. Energy is conducted to the copper plates (3) and (4) by cables (2). Plate (4) emanates an electron flow (6) to the oxidized shaving blade (5) causing the procedure of "de-oxidation" already described and liberation of $O_2$ (7).

Figure 2:
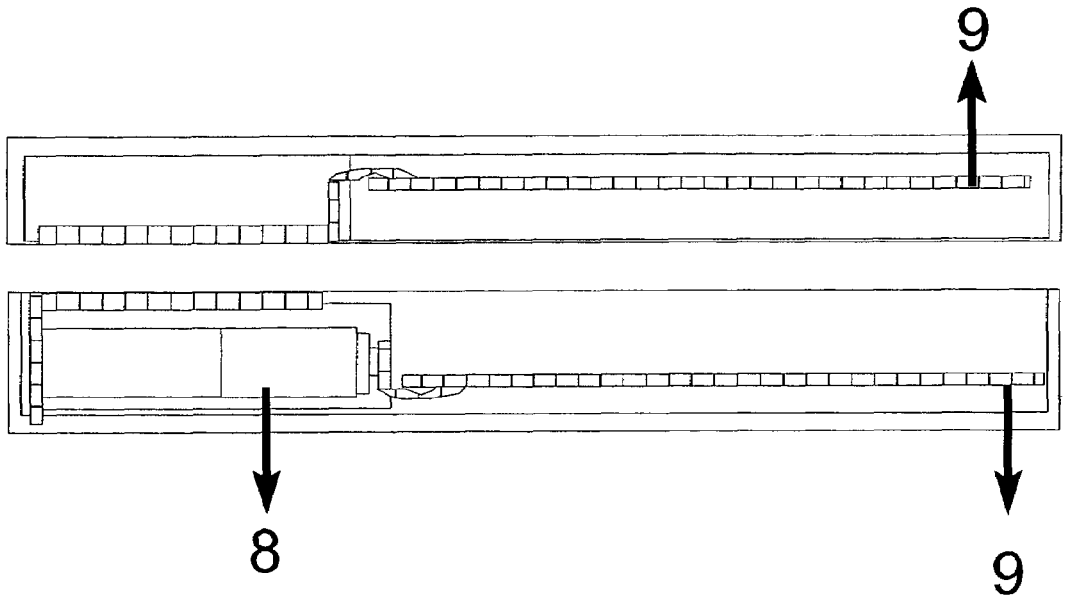
FIG. 2 is a lateral view of a device in accordance with aspects of the invention in a container.

FIG. 2 corresponds to a lateral view of the device in a container where the numerical reference (8) indicates the battery of 1.5V, while reference (9) indicates the copper plates.

As the device is seen in FIG. 2 placed in a container, which can be made of different materials such as plastic, metal or wood, for example, nevertheless, plastic is preferably used because of its price and accessibility.

Figure 3:
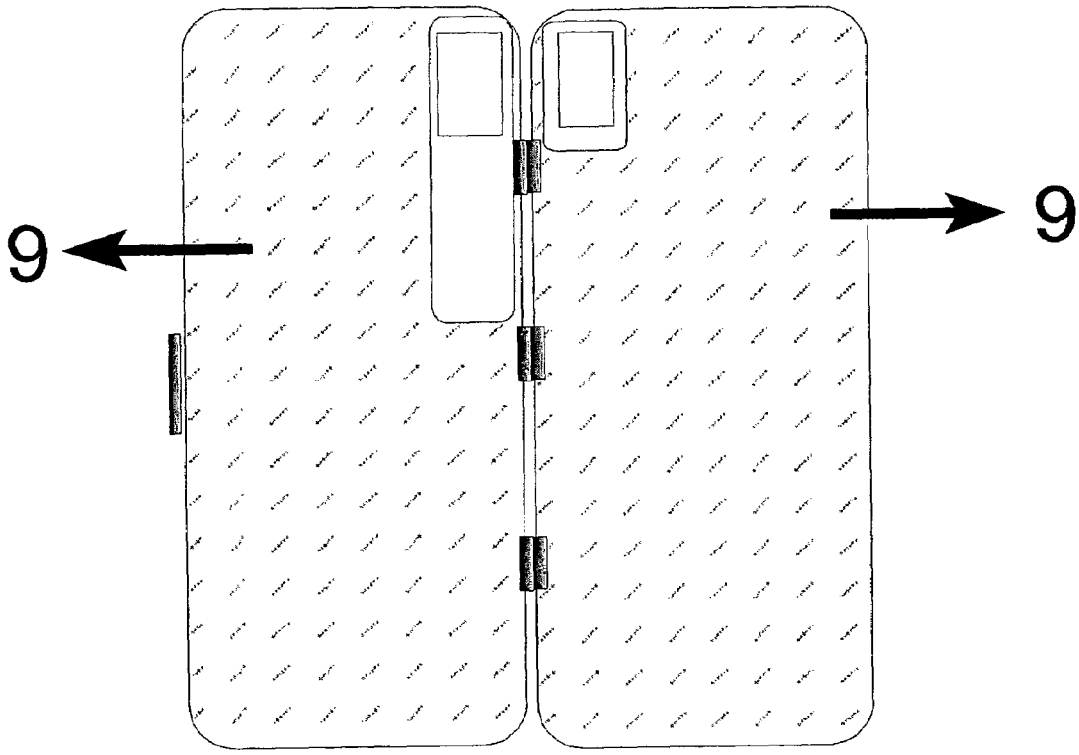
FIG. 3 is a frontal view of the device in a container.
Figure 4:
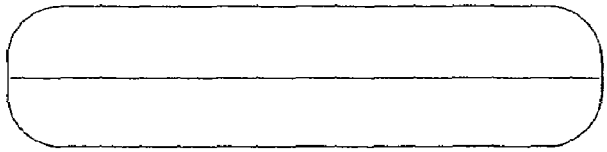
FIG. 4 is an elevational view of the container.
Figure 5:
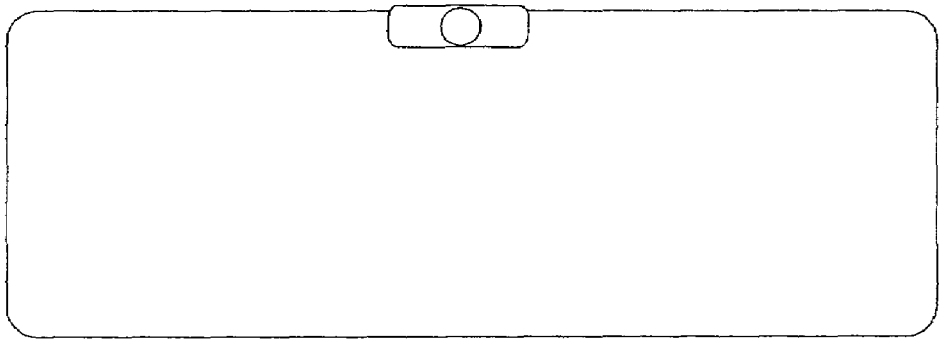
FIG. 5 is a top view of the container.
Figure 6:
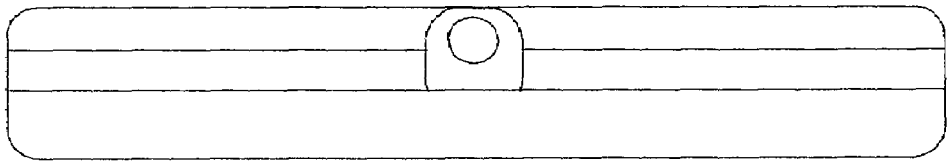
FIG. 6 is a right profile of the container.
Figure 7:
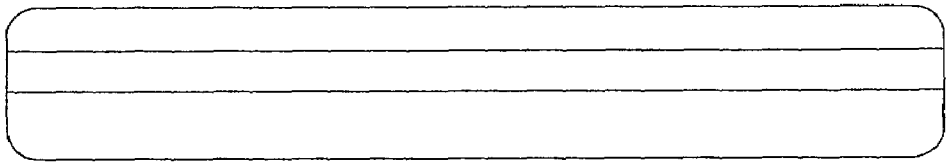
FIG. 7 shows the left profile of the container.
Figure 1:
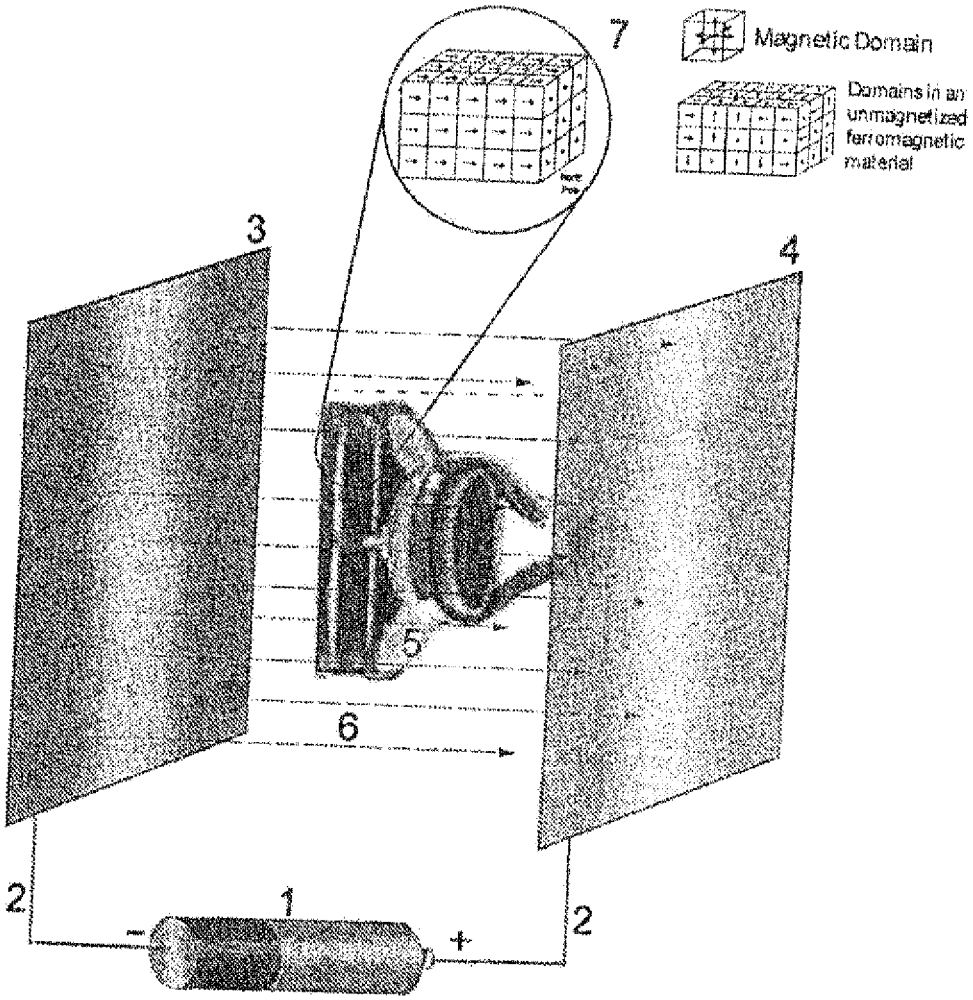
Figure 2:
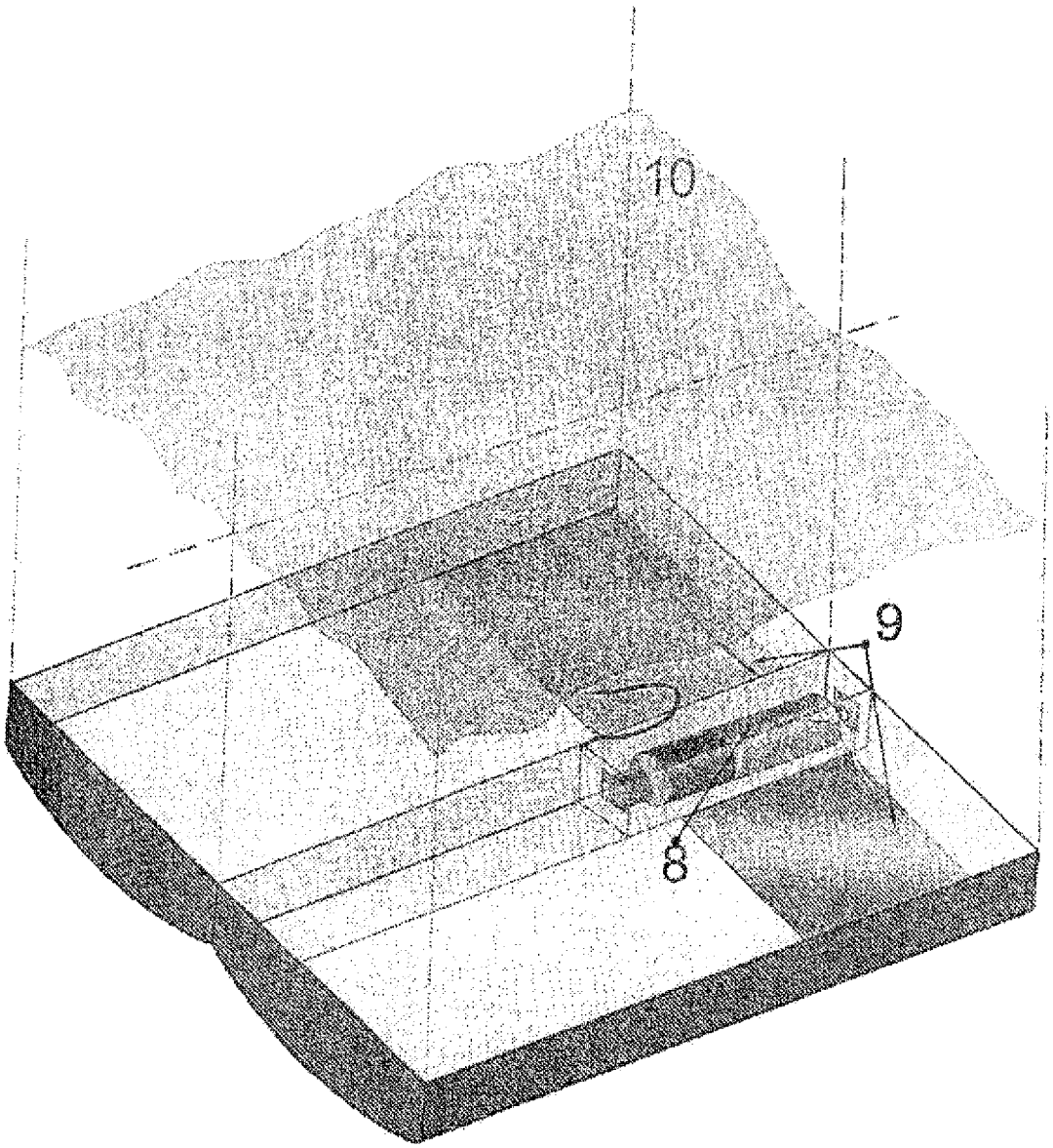
Figure 3:
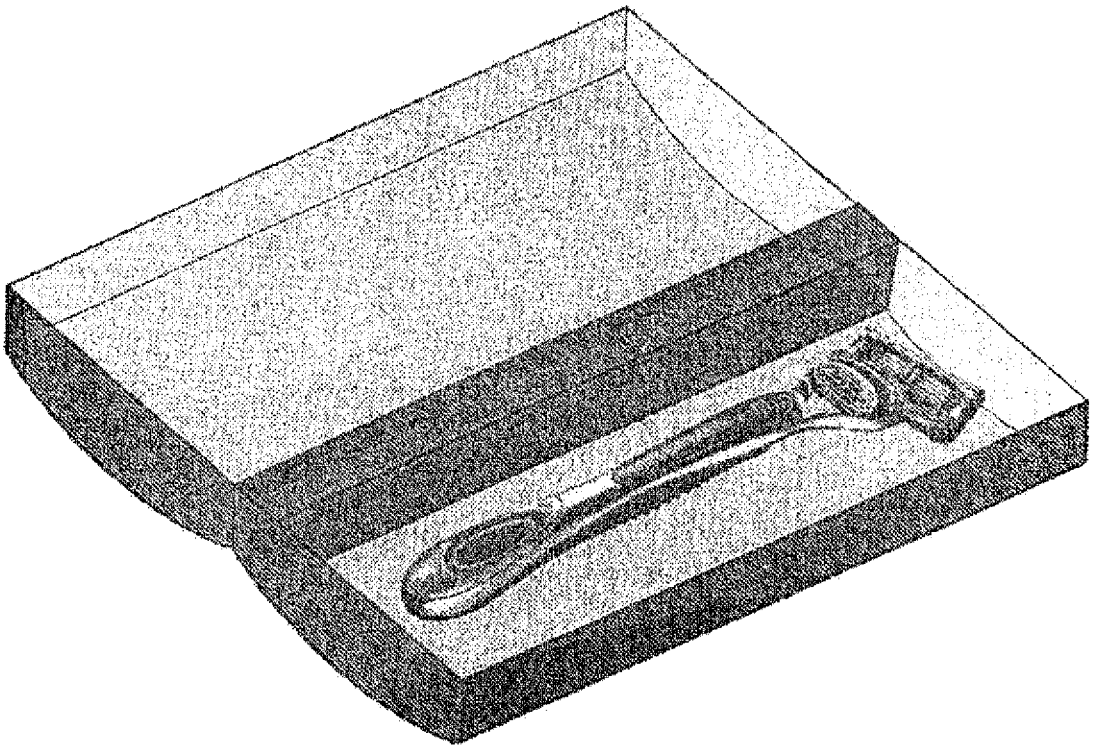
Figure 4:
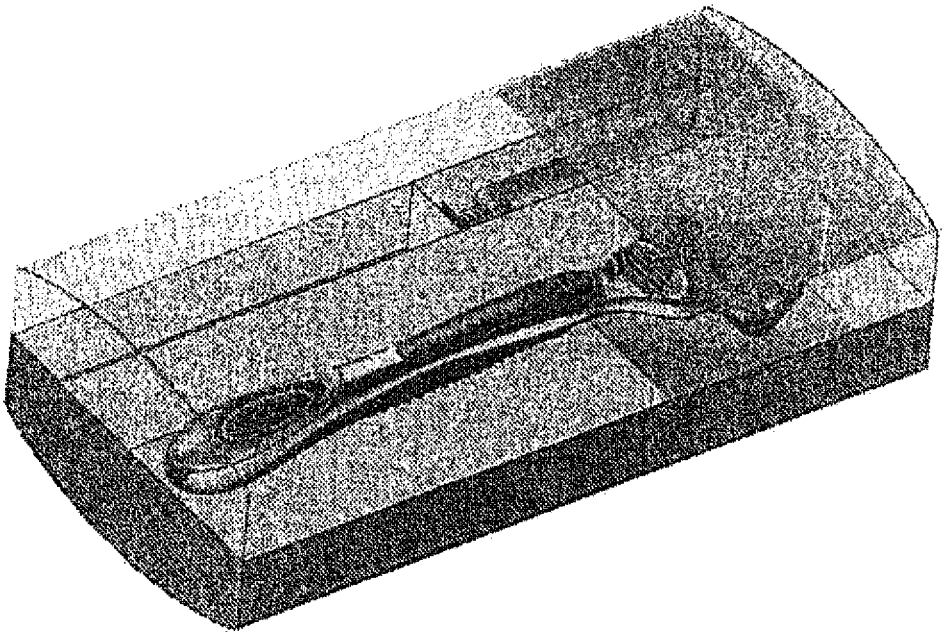
Figure 5:
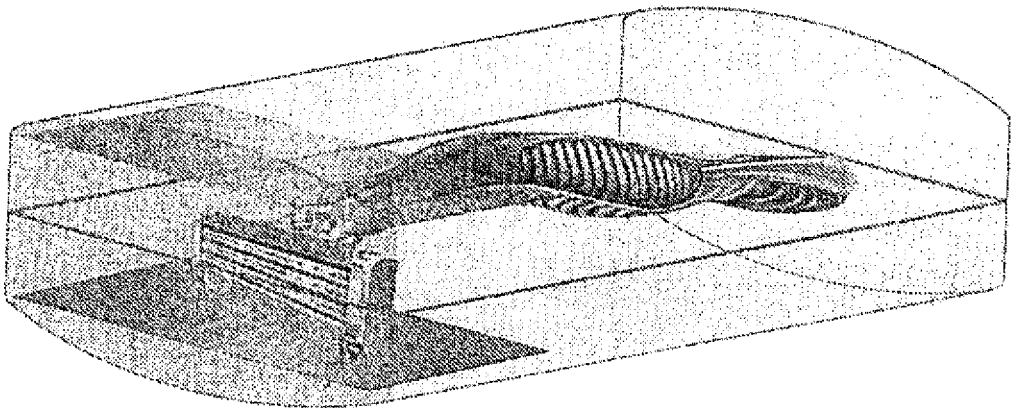

In FIG. 3, a frontal view of the inserted device in a container can be appreciated where numeric reference (9) indicates the copper plates of the device. The plates can possibly be made of other materials that conduct electrons. The preference is copper for its well-known capacity to conduct electricity, to have a reasonable cost and to be a malleable material that is easily adapted for the desired requirements.

Finally, FIGS. 4, 5, 6 and 7 show different views of the container that have different forms and sizes. Nevertheless, preference is for the embodiments illustrated in FIGS. 4, 5, 6 and 7.

Although this invention has been described in connection with specific forms thereof, it will be appreciated that a wide variety of equivalents may be substituted for the specified elements described herein without departing from the spirit and scope of this invention as described in the appended claims.

The invention claimed is:

1. A device that prolongs the lifespan of a shaving blade comprising:

a condenser disposed in air, which comprises a pair of spaced apart parallel copper plates adapted to receive the shaving blade between the plates, a source of DC of 1.5 V and a conductor of electricity that leads electrical energy from the source to the copper plates.

2. The device according to claim 1, further comprising a container.

3. The device according to claim 2, wherein the container is preferably plastic.

4. The device according to claim 1, wherein the source is one AAA battery of 1.5 volts.

5. A method of prolonging the lifespan of a shaving blade comprising:

placing the shaving blade within a container that includes the device according to claim 1 so that it is located between the parallel copper plates.

6. A device for prolonging the lifespan of a blade comprising:

a first metal plate and a second metal plate, the metal plates disposed in air and substantially parallel to one another and spaced from one another such that a blade may be disposed between the plates;

a power source coupled to the plates; and a conductor coupled to the power source and the metal plates, the conductor adapted to lead electrical energy from the power source to the metal plates, the conductor negatively charging the first metal plate and positively charging the second metal plate such that electrons from the first metal plate flow to the second metal plate while contacting the blade;

wherein the blade is spaced from both of the metal plates.

7. A device that prolongs the lifespan of a shaving blade consisting essentially of:

a condenser, consisting essentially of a pair of spaced apart parallel copper plates adapted to receive the shaving blade between the plates, a source of DC of 1.5 V and a conductor of electricity that leads electrical energy from the source to the copper plates.

* * * * *

UNITED STATES PATENT AND TRADEMARK OFFICE

CERTIFICATE OF CORRECTION

PATENT NO. : 7,540,945 B2
APPLICATION NO. : 11/262621
DATED : June 2, 2009
INVENTOR(S) : Salvatierra It is certified that error appears in the above-identified patent and that said Letters Patent is hereby corrected as shown below:

The title page should be deleted to appear as per attached title page.

The sheets of drawings consisting of figures 1-7 should be deleted and replaced with figures 1-5.

Signed and Sealed this

First Day of September, 2009

David J. Kappos

David J. Kappos
*Director of the United States Patent and Trademark Office*

(12) United States Patent
Marquéz Salvatierra

(10) Patent No.: US 7,540,945 B2
(45) Date of Patent: Jun. 2, 2009

(54) ANTICORROSIVE TREATMENT FOR SHAVING BLADES

(76) Inventor: Manuel Antonio Marquéz Salvatierra, Av. Concordia 0487, Peñaflor, Santiago (CL)

( * ) Notice: Subject to any disclaimer, the term of this patent is extended or adjusted under 35 U.S.C. 154(b) by 187 days.

(21) Appl. No.: 11/262,621

(22) Filed: Oct. 31, 2005

(65) Prior Publication Data

US 2007/0025898 A1 Feb. 1, 2007

(30) Foreign Application Priority Data

Jul. 29, 2005 (CL) ..... 1929-2005

(51) Int. Cl.
*C23F 13/20* (2006.01)

(52) U.S. Cl. ..... 204/196.37

(58) Field of Classification Search ..... 204/196.37
See application file for complete search history.

(56) References Cited

U.S. PATENT DOCUMENTS 3,242,064 A 3/1966 Byrne
3,692,650 A 9/1972 Kipps et al.
3,857,050 A * 12/1974 Harris et al. ..... 310/13
4,546,482 A * 10/1985 Bagaglia et al ..... 372/86
4,658,365 A * 4/1987 Syrett et al. ..... 205/724
4,767,512 A 8/1988 Cowatch et al.
6,326,544 B1 * 12/2001 Goheen ..... 136/253
6,395,982 B2 * 5/2002 Nelson et al. ..... 174/555
6,488,834 B1 * 12/2002 Francis ..... 205/652

OTHER PUBLICATIONS

Websters New World Dictionary (1988) p. 207.*

* cited by examiner

*Primary Examiner*—Bruce F Bell
(74) *Attorney, Agent, or Firm*—DLA Piper LLP

(57) ABSTRACT

A device that prolongs the life of a shaving blade including a condenser, a pair of spaced apart and substantially parallel copper plates adapted to receive the shaving blade between the plates, a source of DC of 1.5V and a conductor of electricity that leads electrical energy from the source to the copper plates.

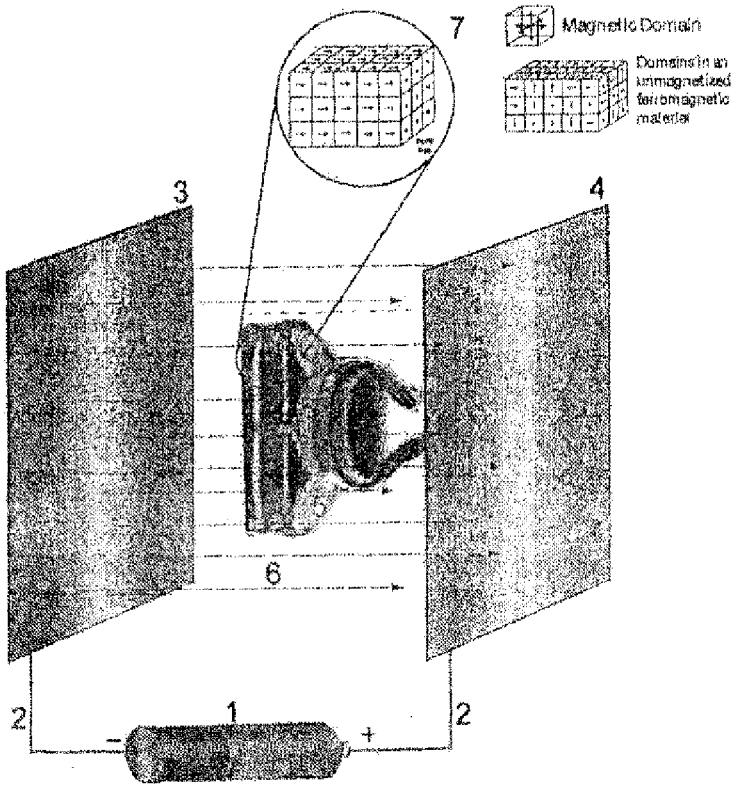

7 Claims, 4 Drawing Sheets